US007870933B2

(12) United States Patent
McInnes

(10) Patent No.: US 7,870,933 B2
(45) Date of Patent: Jan. 18, 2011

(54) PORTABLE HAMMOCK ASSEMBLY

(76) Inventor: Richard E. McInnes, 425 Three Oaks Rd., Cary, IL (US) 60013

( * ) Notice: Subject to any disclaimer, the term of this patent is extended or adjusted under 35 U.S.C. 154(b) by 988 days.

(21) Appl. No.: 11/294,279

(22) Filed: Dec. 3, 2005

(65) Prior Publication Data

US 2006/0151244 A1 Jul. 13, 2006

Related U.S. Application Data

(60) Provisional application No. 60/593,372, filed on Jan. 7, 2005.

(51) Int. Cl.
*A45F 3/24* (2006.01)

(52) U.S. Cl. ..... 182/128; 182/135; 5/120; 5/127; 5/128; 5/130

(58) Field of Classification Search ..... 182/128, 182/135; 5/120, 127, 128, 130; 248/218.4, 248/219.1; 452/187, 188, 189
See application file for complete search history.

(56) References Cited

U.S. PATENT DOCUMENTS 484,565 A * 10/1892 Allison et al. ..... 248/323
672,228 A 4/1901 Huff
808,142 A * 12/1905 Danhour ..... 211/65
1,457,066 A * 5/1923 Kestner ..... 248/240.3
1,754,082 A * 4/1930 Chase ..... 248/219.1
2,382,528 A 8/1943 Anderegg
2,964,200 A * 12/1960 King ..... 108/135
3,580,534 A * 5/1971 Lindsey ..... 248/219.1
3,749,200 A * 7/1973 Meyer ..... 182/187
3,975,580 A * 8/1976 Lewis ..... 174/45 R
4,708,221 A 11/1987 Kubiak
4,744,537 A 5/1988 Buckley
4,813,441 A 3/1989 Kepley
4,886,143 A * 12/1989 Dubroc ..... 182/142
5,186,276 A 2/1993 Craig
5,263,675 A * 11/1993 Roberts et al. ..... 248/219.4
5,292,014 A * 3/1994 Lelong ..... 211/85.23
5,435,412 A * 7/1995 Franklin et al. ..... 182/188
5,579,548 A 12/1996 Death
5,601,274 A * 2/1997 Minor et al. ..... 248/594
5,820,455 A * 10/1998 Breedlove ..... 452/187
6,059,240 A 5/2000 Gorsuch
6,062,974 A * 5/2000 Williams ..... 452/187
D431,890 S * 10/2000 Twilligear et al. ..... D34/33
6,202,964 B1 * 3/2001 Thornhill ..... 248/219.4

(Continued)

*Primary Examiner*—Katherine W Mitchell
*Assistant Examiner*—Colleen M Quinn
(74) *Attorney, Agent, or Firm*—Meroni & Meroni, P.C.; Charles F. Meroni, Jr.; Christopher J. Scott

(57) ABSTRACT

A portable hammock (kit) with artificial limb assembly enables a user to selectively support a vertical load adjacent a select vertical support structure. The artificial limb assembly comprises a pair of compression members and first and second tension members. Each compression member has first and second compression ends. The first compression ends are drawn together such that the longitudinal axes of the members substantially intersect. The second compression ends are thus spaceable from one another. The first tension member interconnects the second member ends and receives a supportive outer surface of the vertical support structure. The second tension member interconnects the first compression ends with the vertical support structure at a superior portion thereof. The first compression ends at an opposite portion receive the vertical load.

15 Claims, 8 Drawing Sheets

U.S. PATENT DOCUMENTS 6,467,110 B1 10/2002 Ketcher
6,508,446 B1 * 1/2003 Addison et al. ..... 248/218.4
6,695,688 B1 * 2/2004 Owen et al. ..... 452/187
6,708,832 B1 * 3/2004 Hannon ..... 211/107
6,739,964 B2 * 5/2004 Gearhart ..... 452/187
6,748,616 B1 6/2004 Tseng
6,934,983 B1 8/2005 Johnston
7,476,149 B2 * 1/2009 Burrows ..... 452/187
7,544,120 B1 * 6/2009 Tardif et al. ..... 452/187

* cited by examiner

FIG. 5
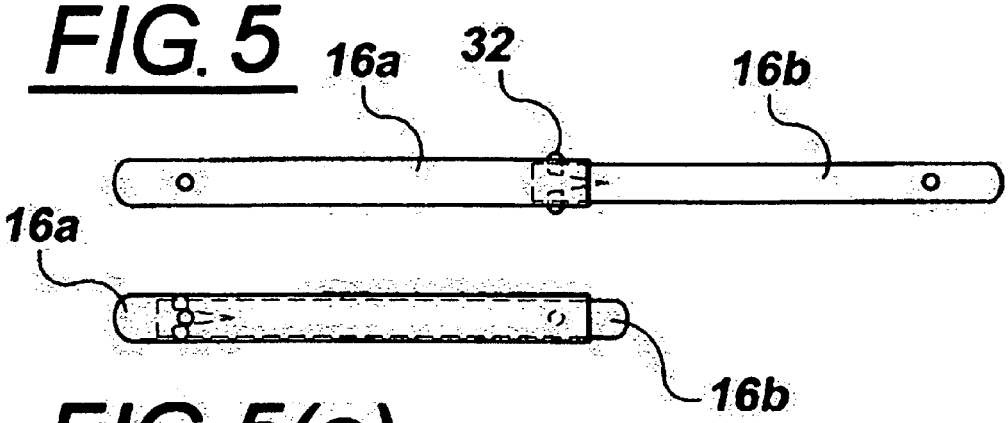
FIG. 5(a)
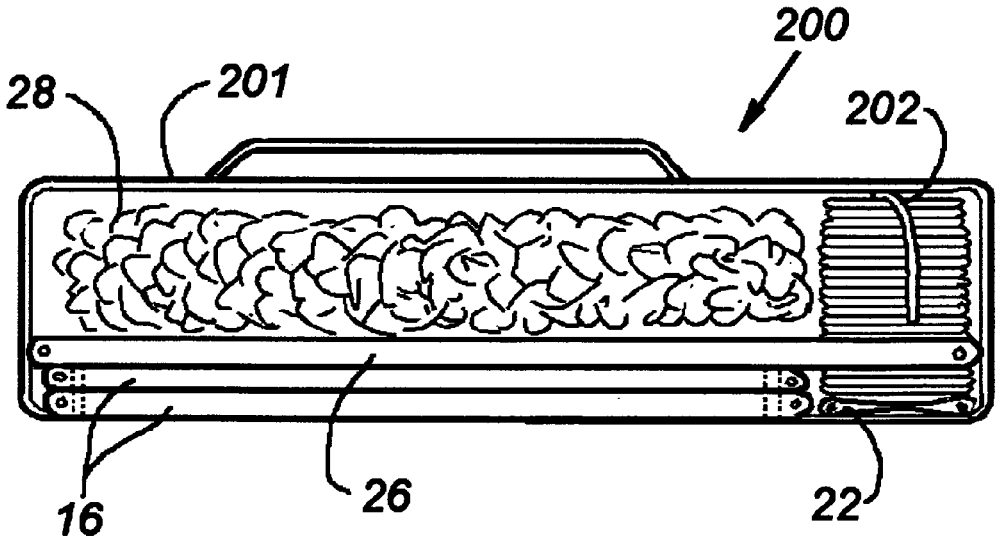
FIG. 6

PORTABLE HAMMOCK ASSEMBLY

PRIOR HISTORY

This application is a non-provisional patent application claiming the benefit of U.S. Provisional Patent Application No. 60/593,372, filed in the United States Patent and Trademark Office on Jan. 7, 2005.

BACKGROUND OF THE INVENTION

1. Field of the Invention

The present invention generally relates to a portable hammock assembly comprising a uniquely configured artificial limb for attachment to a vertical support structure. More particularly, the present invention relates to a portable hammock assembly with an artificial limb for attachment to a vertical support structure, Which artificial limb functions to support cooperatively associated hanging objects, such as a hammock-borne user, in adjacency to the vertical support structure.

2. Description of Prior Art

A number of pertinent prior art disclosures relating to hammock assemblies and the like are briefly described hereinafter.

U.S. Pat. No. 4,744,537 ('537 patent), which issued to Buckley, discloses a Hanger Bracket. The '537 patent teaches an improved hanging device for various applications that is comprised of four major components which are: a hanging bracket, an elastic band, a sling and a shackle. The sling can be used alone or in conjunction with the hanging bracket or shackle to support various devices. No marring or defacing of the supporting structure is required for use of this device.

U.S. Pat. No. 5,579,548 ('548 patent), which issued to Death, discloses a Hammock Harnessing Device. The '548 patent teaches a device for harnessing a hammock to a tree or other load bearing member comprises a gripping belt, and spanning belt, and preferably a belt loop which helps to anchor the belts together, and a snap-hook for securing the spanning belt to the hammock. The gripping belt includes a belt buckle for releasably cinching the gripping belt around the load bearing member. The spanning belt is dimensioned for encircling the load bearing member and spanning the distance between the hammock and the load bearing member. A section of the interior portion of the spanning belt is twisted over and anchored to the gripping belt at a preselected belt intersection area, so that the free end portions of the spanning belt extend away from and below the intersection area at a preselected angle correlatable with known angles assumed by the spanning belt when hammocks are harnessed to load bearing members and placed under loads.

U.S. Pat. No. 6,934,983 ('983 patent), which issued to Johnston, discloses a Hammock Hanging Apparatus. The '983 patent teaches an apparatus for hanging a hammock with opposing ends using a single vertical support, comprising an elongated arm having opposing ends and a longitudinal axis; a butt plate fixedly connected to one end of the arm so as to be substantially perpendicular to the longitudinal axis of the arm; a suspension mechanism having a first portion, for circumferentially extending around the vertical support, and a second portion for extending downwardly from the first portion to the arm for connection thereto at first and second longitudinally spaced connection points to thereby securely support the arm, with the butt plate abutting the vertical support such that the arm extends outwardly and substantially horizontally from the vertical support; a gripper belt for circumferentially extending at least partially around the vertical support so as to securely hold the butt plate in its position abutting the vertical support; and a hammock hanging mechanism for connection of the opposing ends of the hammock to the arm at respective third and fourth longitudinally spaced connection points, the third connection point being longitudinally adjacent to the first connection point and the fourth connection point being longitudinally adjacent to the second connection point.

A number or other reasonably related prior art disclosures are briefly described hereinafter.

U.S. Pat. No. 4,708,221 ('221 patent), which issued to Kubiak, discloses a Tree Stand with Pin-up System. The '221 patent teaches a tree stand comprising a pin up system for easy attachment and removal to a tree high above the ground. The tree stand includes a frame and a platform attached to the frame for supporting the weight of a user and equipment. A hanger stud having a rectangular cross section projects from the frame towards the ground. The tree stand is attached to the tree trunk with a hanger pin which includes a shank with a pointed screw tip at one end for penetrating into the tree trunk. A crank is attached to the shank for rotating the shank and facilitating penetration of the screw tip and shank into the tree trunk. A stud holder is attached to the shank and has an aperture with the same rectangular cross-sectional shape as the hanger stud and is adapted to receive the hanger stud in the aperture to securely hold the frame on the tree trunk. In addition, an automotive seat belt is attached to the frame of the tree stand and is wrapped around the tree trunk to more securely hold the tree stand to the trunk. A pair of projections extend from the frame towards the tree trunk provide added frictional contact and in conjunction with the seat belt and the pin up system to firmly and safely support the tree stand on the tree trunk.

U.S. Pat. No. 4,813,441 ('441 patent), which issued to Kepley, discloses a Camouflage Device for Hunter's Seat. The '441 patent teaches a camouflage device for use with a hunter's seat of the type secured to a tree and comparing an extension member for being secured adjacent one of its ends to the seat with the other of its ends extending outwardly therefrom. A cross member is secured to the outwardly extending end of the extension member and a plurality of brush holders is positioned at intervals along the length of the cross member for holding brush in a substantially upright position in front of the hunter's seat for camouflaging an occupant of the seat.

U.S. Pat. No. 5,186,276 ('276 patent), which issued to Craig, discloses a Portable Hunting Tree Stand. The '276 patent teaches a portable hunting tree stand adapted to be removably connected to a tree trunk comprising a platform, a seat, at least one frame member connected between the seat and platform, and arm means connected to the frame member for hanging a hunting bow thereon so that a hunter's hands may remain free and unencumbered while the hunter is seated atop the seat and while the bow is not in use, and wherein the bow is easily reached by the hunter when the hunter desires to use the bow. The arm means is an arm pivotally connected to a frame member, and includes a U-shaped bracket connected thereto wherein a bow may be removably placed therein. In another embodiment, the tree stand comprises a platform, a seat, at least a first frame member connected between the seat and the platform, at least a second tubular frame member connected to the first frame member, and arm means connected to the tubular member by inserting one end into the tubular member. In another embodiment, the tree stand comprises a platform, a seat, at least one frame member connected between the seat and platform, at least one cable connected between the frame member and the platform, and arm means connected to the cable.

SUMMARY OF THE INVENTION

In contradistinction to the foregoing prior art, the present invention provides a portable, artificial limb assembly for supporting vertical loads in general and a hammock or hammock type chair in particular. The artificial limb assembly comprises two compression members and two tension members. The compression members can be manufactured from wood, certain composite(s), plastics, or metal and may be solid, tubular or hollow. The tension members can be made of any material that has the required strength and can be flexible or rigid. Steel cables, steel chain, aluminum chain, aluminum cable, woven (e.g. nylon) straps, or rope may very well provide the required tension strength.

The two compression members provide two sides of a triangle and provide the stability to support the load. A first tension member or sling provides certain means for maintaining the inferior ends of the compression members at a preferred spacing and thus prevents the inferior ends of the compression members from spreading apart at the tree, post, pole, or vertical surface. The first tension member thus provides certain means for transferring the vertical load through the compression members to the tree, post, pole, or vertical wall.

The tension components make up the remainder of a tetrahedron. The tension components provide certain means for holding the compression members so they are pointed up and away from the tree, post, pole, or vertical surface. The tension members also provide certain means for attaching the device to the tree, post, pole, or vertical surface. The tension members further provide certain means for supporting the sling to keep the compression members from sliding down or spreading apart and bypassing the tree, post, pole, or vertical surface.

The compression members can be constructed from materials that telescope so they can be stowed in a smaller package for transporting and selectively extended for use. The rope can be replaced with any material that will carry a load in tension (chain, cable, rods, bars, etc).

The artificial limb assembly of the present invention could be used to provide a support point off of any tree, post, pole or vertical support surface. One example would be to attach a hoist for pulling a car engine. A second example would be to attach a hammock assembly or hammock type chair.

In other words, the invention discloses a wrappable member, such as a rope, chain, cable, or strap, which wrappable member may be tied or looped around a tree, pole, or post. Two compression sticks are attached to each other at one end and a tensioned rope, chain, or cable is connected between the tree and the common end of the sticks. The opposite ends of the sticks are spaced from one another adjacent a tree, post, pole, or vertical support surface (e.g. a wall). A sling rests against the tree, post, or pole to hold the sticks from spreading and bypassing the tree, post, or pole. A tension member (rope, chain, or cable) passes from the cable, chain or rope attached to the tree to the lower ends of the sticks. The combination of compression sticks, tension ropes, and sling form a tetrahedron with the vertices of the sticks and tension members providing a portable artificial limb to facilitate hanging in a hammock chair or hanging load.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows:

FIG. 1(*a*) is a fragmentary enlarged perspective view of certain superior portions of the artificial limb assembly showing a first alternative chain attachment structure.

FIG. 5 is a side view of an alternative embodiment of a compression member of the artificial limb assembly of the present invention showing an inner telescopic member received by an outer telescopic member, the inner telescopic member being in a fully extended state.

FIG. 5(*a*) is a side view of the alternative embodiment shown in FIG. 5, the inner telescopic member being a fully received state.

FIG. 6 is a side view depiction of a portable hammock assembly kit of the present invention with parts broken away of the outer package to show inner kit contents.

DETAILED DESCRIPTION OF THE PREFERRED EMBODIMENT

Figure 1:
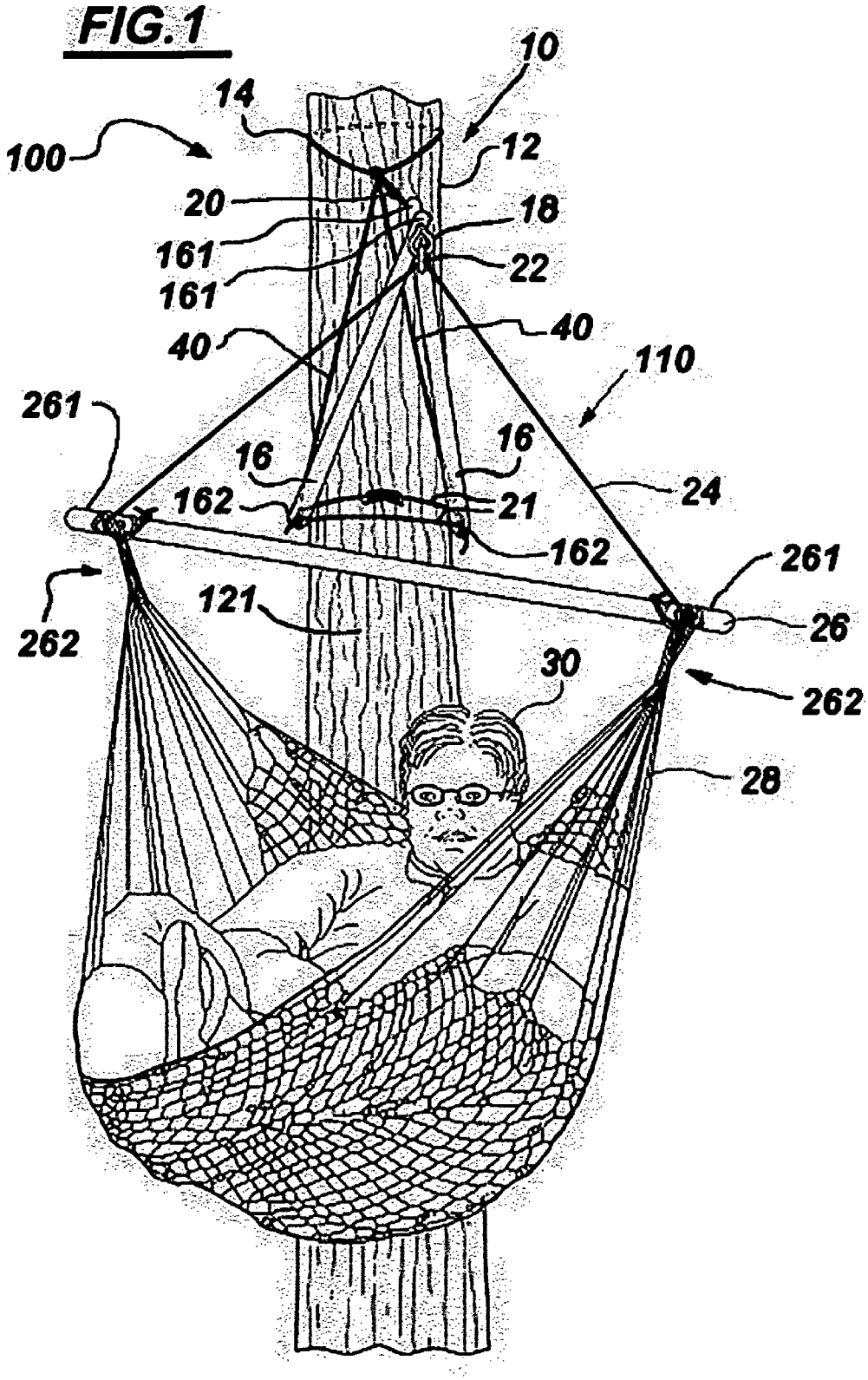
FIG. 1 is a fragmentary perspective view of the portable hammock assembly of the present invention with artificial limb assembly as attached to a tree trunk and laden with a hammock-borne user.
Figure 1A:
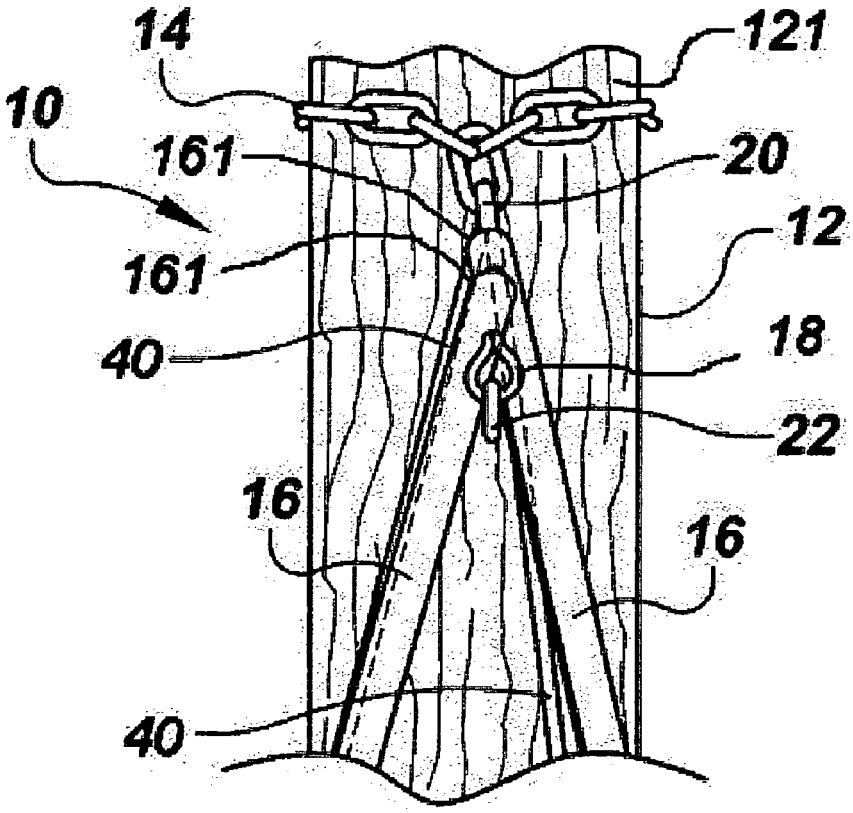

Referring now to the drawings, the preferred embodiment of the present invention concerns a portable hammock assembly 100 and/or kit for outfitting select vertical support structures such as trees, posts, pole, column, or other vertical support structure. It will be seen from an inspection of FIGS. 1-4 that the preferred select vertical support structure may be defined by a tree 12, but need not be limited thereby. As an example, a securely grounded and stabilized 6"×6" beam will function to support vertical loads situated in adjacency thereto. The support can be any size and shape so long as it comprises sufficient strength to support the (vertical) load. It will be understood from a consideration of the noted figures that tree 12 or similar other vertical support structure will necessarily comprise a supportive outer surface 121 (as referenced in FIGS. 1-4), which supportive outer surface 121 inherently has a transverse supportive periphery 122 (as generally depicted in FIG. 2 at the innermost circular line). In the case of tree 12, the supportive outer surface 121 is typically some form of bark and the transverse supportive periphery 122 is generally or substantially round. In the case of a beam, however, the supportive outer surface 121 is usually hewn lumber (as may be coated) and the transverse supportive periphery 122 is typically rectangular (or in the case of a 6"×6" beam: square). It should be noted that smaller supports may also function to support a load and may comprise hex, square, T-shaped, or I-shaped transverse cross-sections.

Figure 2:
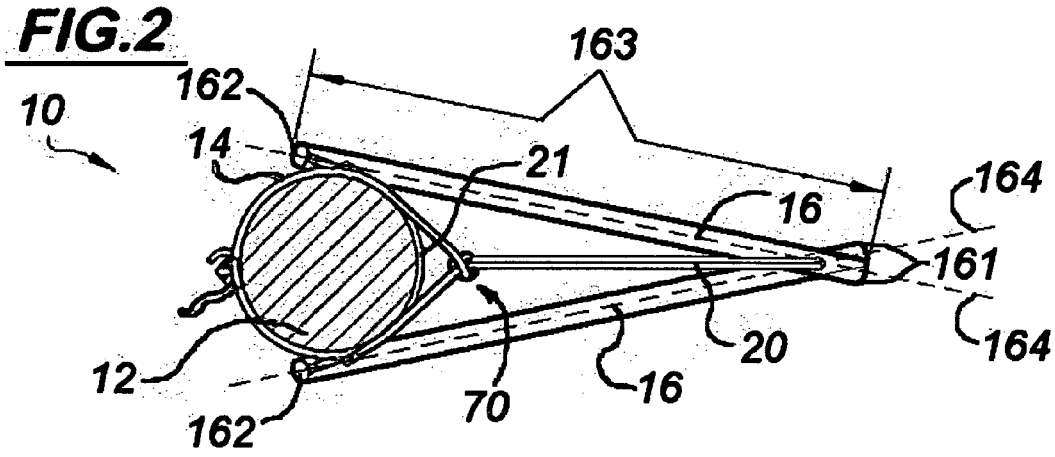
FIG. 2 is a fragmentary top plan view of the artificial limb assembly of the present invention as attached to a tree trunk.

The portable hammock assembly 100 of the present invention is designed to support a vertical (gravitationally-induced) load 101, such as a human hammock enthusiast 30 or other user with a certain weight as illustrated and referenced in FIG. 1. The human hammock enthusiast 30 with certain weight and the hammock assembly 110 (as illustrated and referenced in FIG. 1) with certain hammock assembly weight has been replaced with a generic vector depicting a total vertical load 101 in FIG. 3. It will be seen from an inspection of FIG. 3 that the vertical load 101 is selectively situated adjacent the select vertical support structure or tree 12 as enabled by a hammock support assembly 10 or artificial limb (as further referenced in FIGS. 1-4, inclusive).

Figure 3:
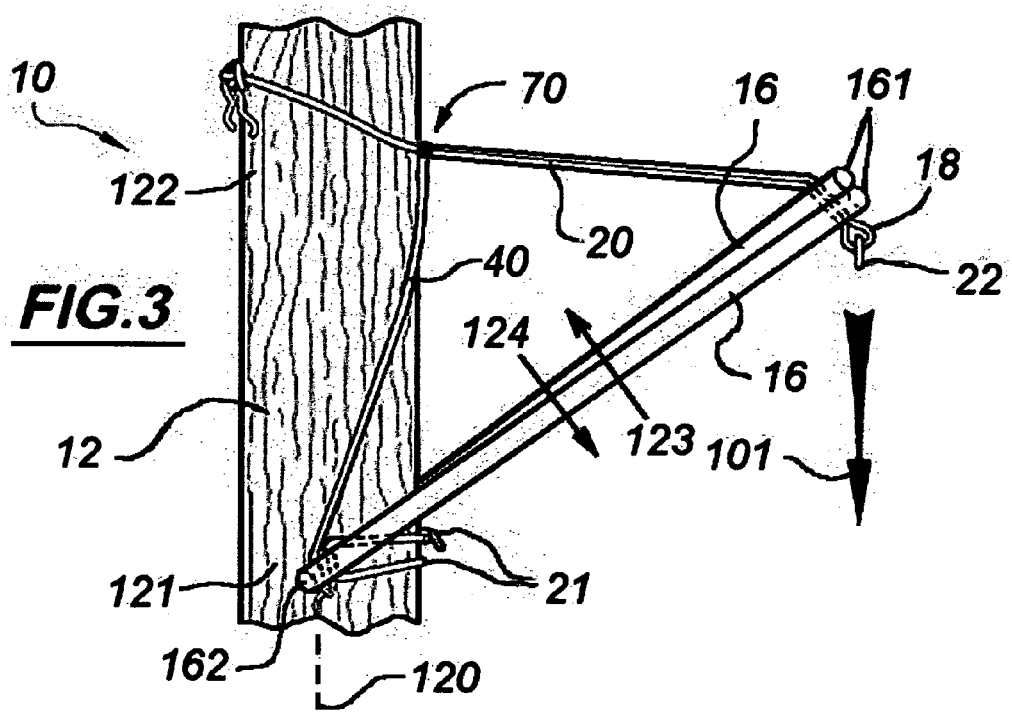
FIG. 3 is a fragmentary side elevation view of the artificial limb assembly of the present invention as attached to a tree trunk.
Figure 4:
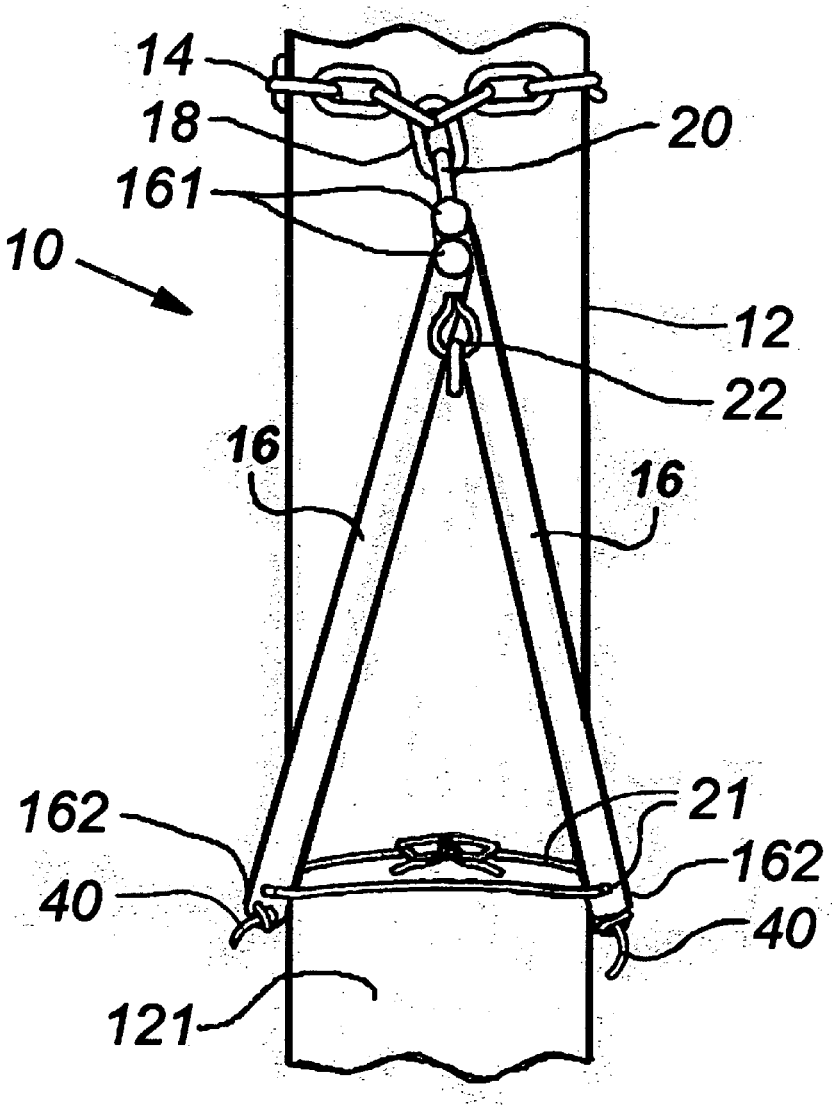
FIG. 4 is a fragmentary enlarged front elevation view of the artificial limb assembly of the present invention showing perspective view of certain superior portions of the artificial limb assembly showing a second alternative chain attachment structure.

The generic artificial limb or specific hammock support assembly 10 of the present invention preferably comprises a pair of rigid compression members 16 as illustrated and referenced in FIGS. 1-4; a first flexible, inelastic tension member 20 as illustrated and referenced in FIGS. 1-4; and a second flexible, inelastic tension member 21 or sling as illustrated and referenced in FIGS. 1, 3, and 4. Second tension member 21 has been illustrated as a looped tension member in the noted figures, having been looped through member-receiving apertures or bores formed in compression members 16 at the inferior ends thereof. The member-receiving bores or apertures roughly define certain axis-intersecting means for enabling a user to orient the compression axes such that the second compression ends are spaceable from one another and the compression axes substantially intersect one another.

Compression members 16 preferably comprise or are constructed from wood, plastic, or metal and may be solid, tubular or hollow. Preferably, compression members 16 measure about 36-40 inches (or 91-100 centimeters) maximum in length and may comprise certain telescoping means. While it is contemplated that compression members 16 may be of a maximal 100 centimeter length, it is contemplated that longer compression members 16 so long as the load-supporting characteristics thereof are not compromised and do not function to support a vertical load too far from the vertical support structure (which may result in vertical support structure failure). The dimensions here recited are the preferred dimensions and are not intended to be limiting.

Notably, it is contemplated that compression members 16 may each comprise at least two telescopic members; namely, one inner recessed member 16(*b*) and one outer housing member 16(*a*), the inner member 16(*b*) being telescopically receivable within the outer housing member 16(*a*). Certain spring tension pins 32 may be used for the telescoping compression struts or members 16(*a*) and 16(*b*). The telescopic members essentially function to enable the user 30 to vary the compression member lengths 163.

Each compression member 16 preferably comprises a (superior) first compression end 161 as referenced in FIGS. 1-4; an (inferior) second compression end 162 as illustrated and referenced in FIGS. 1, 2, 3, and 4; a compression member length 163 as generally depicted in FIG. 2, and a longitudinal compression axis 164 as generally referenced in FIG. 2. It will be seen from an inspection of FIG. 2 in particular (showing an extreme vertical orientation) and FIGS. 1, 1(*a*), 3, and 4 in general that the compression axes 164 substantially intersect one another at the first compression ends 161. Thus, the second compression ends 162 are preferably spaced or are spaceable from one another adjacent the supportive outer surface 121.

The first tension member 21 preferably comprises or is constructed from wire, rope, cable, strap, etcetera, and functions to both interconnect the second member ends 162 and receive the supportive outer surface 121 thus forming a triangulate compression-tension structure. It will be understood that the compression-tension structure inherently has a superior face as generally depicted in FIG. 2 and as generally referenced at arrow 123 in FIG. 3, and an inferior face as generally referenced at arrow 124 in FIG. 3.

The second tension member 20 preferably comprises or is constructed from rope, wire, cable, chain, strap, etc. and functions to attach, adjust, and tighten (i.e. interconnect) the first compression ends 161 with the vertical support structure or tree 12 at the superior face 123 as will be generally understood from an inspection of FIGS. 1-4. Conversely, at the inferior face 124, the first compression ends 161 receive the vertical load 101 via the cooperative association of second tension member 20 (as looped 18 through member-receiving apertures or bores in first compression ends 161) and a swivel ring 22 as illustrated and referenced in FIGS. 1, 1(*a*), 3, and 4.

The hammock assembly 110 preferably comprises hammock chair 28 (preferably a user-supportive net) or other user-receiving structure as illustrated and referenced in FIG. 1; a cross member or bar 26 as illustrated and referenced in FIG. 1; and at least one tension line (preferably comprising or constructed from rope, cable, wire, etc.) or similar other attachment means 24 as illustrated and referenced in FIG. 1. Notably, the hammock assembly inherently has a certain hammock weight, which together with the user's weight comprises the vertical load 101 in the illustrated example.

The cross member 26 preferably comprises or is constructed from wood, plastic, or metal and inherently has first and second cross ends 261. Cross bar 26 is designed for spreading or separating certain chair or hammock attachment ends 262 as further generally depicted in FIG. 1. The tension line 24 interconnects the first and second cross ends 261 to the first compression ends 161 at the inferior face 124 via the ring attachment means or swivel ring 22. The user-receiving structure 28 is thus cooperatively associated with the cross member 26 for receiving and supporting the user 30, who inherently has some user weight. As previously indicated, the sum of the user weight and the hammock weight is equal to the vertical load 101 in the illustrated example and the portable hammock assembly 100 thus operates to support the vertical load 101 adjacent the select vertical support structure or tree 12.

It will be further seen from an inspection of FIGS. 1-4 that the second tension member 20 of the portable hammock assembly 100 preferably further comprises a peripheral-wrapping portion 14, which may preferably function to serve as the main attachment means to tree 12 and preferably comprises chain, rope, strap, cable, etc. The peripheral-wrapping portion wraps around the supportive periphery 122 for stabilizing or for enhancing hammock support of the hammock support assembly 10. It will be further seen from an inspection of the figures that the second tension member 20 has a certain tension length interconnecting the first compression ends 161 with the vertical support structure or tree 12 at the superior face 123, the tension length may preferably be adjustable for varying the distance intermediate the vertical load 101 and the select vertical support structure or tree 12.

It will be seen from an inspection of FIG. 3 that the longitudinal compression axes are angled outwardly from the longitudinal tree axis 120 at about 45 rotational degrees. This angle represents a preferred maximum angle so as to maximize distance from the vertical support structure while minimizing the possibility of slippage. It is contemplated, however, that a maximum angle ranging from 75-95 degrees from the longitudinal axis may well function to prevent inversion (via slippage or some other means) of the hammock support assembly intermediate the supportive outer surface 121 and first tension member 21. For example, it is contemplated that if sufficiently inelastic tension member 21 is utilized, a maximum angle of about 95 degrees from the longitudinal tree axis 120 is achievable for supporting vertical loads a the vertical support structure. Thus it is contemplated that the tension length also inherently has a maximal tension dimension for maximizing the distance intermediate the vertical load 101 and the select vertical support structure. Given an angle of about 45 degrees and a maximal compression length of about 36-40 inches (or 91-100 centimeters), it is contemplated that the maximal tension dimension is on the order of about 70.7 centimeters.

It will be further seen from an inspection of FIGS. 1, 1(*a*), 3, and 4 that certain tension-dispersing stabilizer members 40 may function to both interconnect the second tension member 20 with the second compression member ends 162 and contact the supportive outer surface 121 for stabilizing the hammock support assembly 10 adjacent the select vertical support structure. Preferably, the stabilizer members 40, the first and second tension members 21 and 20, and the second compression member ends 162 comprise certain non-abrasive structure for preventing and or minimizing damage to the supportive outer surface 121. In this regard, it is contemplated that second compression member ends 162 may be rounded and that the materials used in the construction of the tension members 20 and 21, and stabilizer members 40 be nylon rope or similar other material having low friction characteristics.

As earlier prefatorily indicated and as inherently taught by the portable hammock assembly 100, it is contemplated that the present invention further discloses or teaches a vertical load support kit 200 as generally depicted in FIG. 6 as packaged within a duffle type bag 201 for ease of transport or portability. The vertical load support kit 200 essentially enables the user 30 to outfit a select vertical support structure with certain vertical load-supporting means. In this regard, it is contemplated that the vertical load support kit may preferably comprise a pair of compression members 16, first and second tension members 21 and 20, two stabilizer members 40, a tension line 24 (structures 14, 20, 21, 24, and 40 all provided in a dividable single line 202 as shown coiled within bag 201), a cross member 26, a hammock chair 28, and a swivel ring 22, substantially as earlier described, but packaged in the form of a kit for enabling a user to transport and outfit select (vertical) support structures. For example, it is contemplated that the kit could be transported to a wooded park and installed adjacent to ground level so that, once installed, substantially as described, the user could then gain access to the user-receiving hammock chair 28 from ground level as generally depicted in FIG. 1.

Thus, while the foregoing descriptions contain much specificity, the same should not be construed as limiting the scope of the invention, but rather as an exemplification of the invention. For example, it is contemplated that the essence of the invention teaches a vertical load support assembly for supporting a vertical load adjacent a select vertical support structure and comprising a pair of compression members and first and second tension members. Each compression member has a superior first compression end, an inferior second compression end, a compression member length, and a longitudinal compression axis. The compression axes substantially intersect one another at the first compression ends and the second compression ends are spaceable from one another.

The first tension member interconnects the inferior second member ends and receives a supportive outer surface of the select vertical support structure thus forming a triangulate compression-tension structure. The compression-tension structure has a superior face and an inferior face. The second tension member interconnects the first compression ends with the vertical support structure at the superior face. Further, the first compression ends at the inferior face may then receive a vertical load. The vertical load may comprise a user's weight along with the weight of a hammock assembly substantially as described herein, the combination of elements being distinctive to the art.

A flexible, inelastic tension member such as a rope, chain, cable, or strap is tied or looped around a tree, pole, post, column or similar other select vertical support structure. Two compression members are attached to each other at one end and a tensioned member is connected between the select vertical support structure and the common end of the compression members. The opposite ends of the compression members straddle the select vertical support structure and are spaced apart. A tensioned sling rests against the select vertical support structure to prevent the compression members from spreading and bypassing the vertical support structure. A further tension member may preferably pass from the common end tensioned member to the inferior ends of the compression members for further stabilization and tension dispersion. The combination of compression members, tension(ed) members, and sling form a tetrahedron with the vertices of the compression and tension members providing a portable artificial limb to facilitate hanging in a hammock chair or similar other hanging load.

It will thus be seen that the present invention essentially discloses a portable hammock assembly 100 for supporting a vertical load 101 adjacent a vertical support structure (e.g. a tree). The portable hammock assembly 100 according to the present invention essentially and preferably comprises a support assembly as at 10 and a hammock or hammock assembly as at 110.

Figure 7:
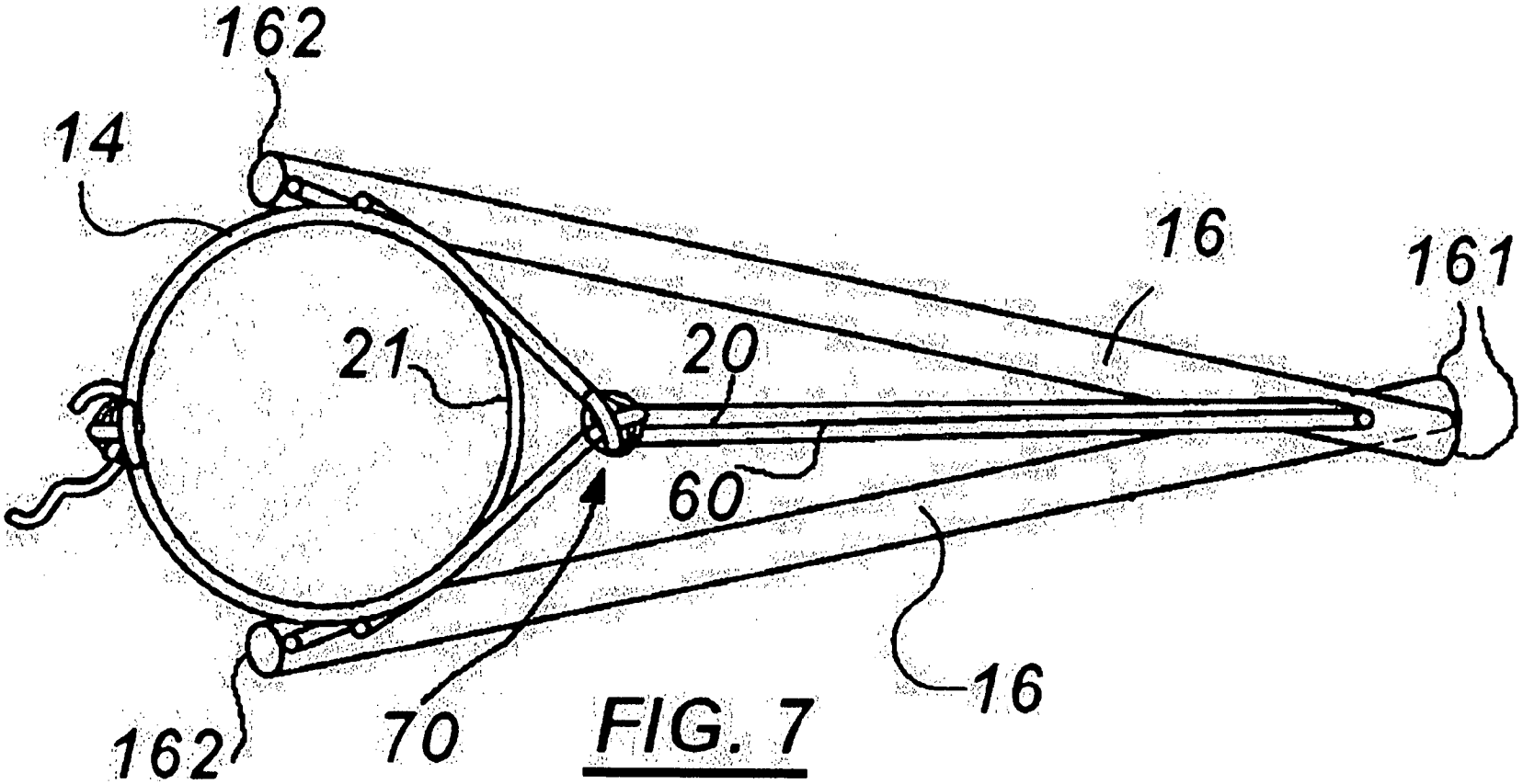
FIG. 7 is an enlarged view of the artificial limb assembly according to the present invention as otherwise depicted in FIG. 2.
Figure 8:
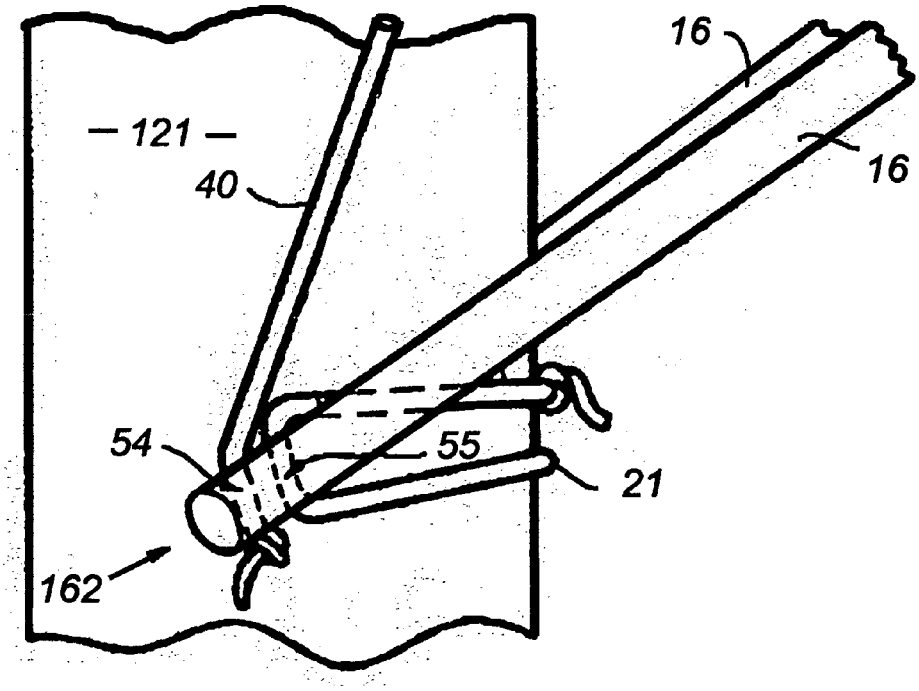
FIG. 8 is an enlarged fragmentary view of the bottom portions of the artificial limb assembly according to the present invention as otherwise depicted in FIG. 3.
Figure 9:
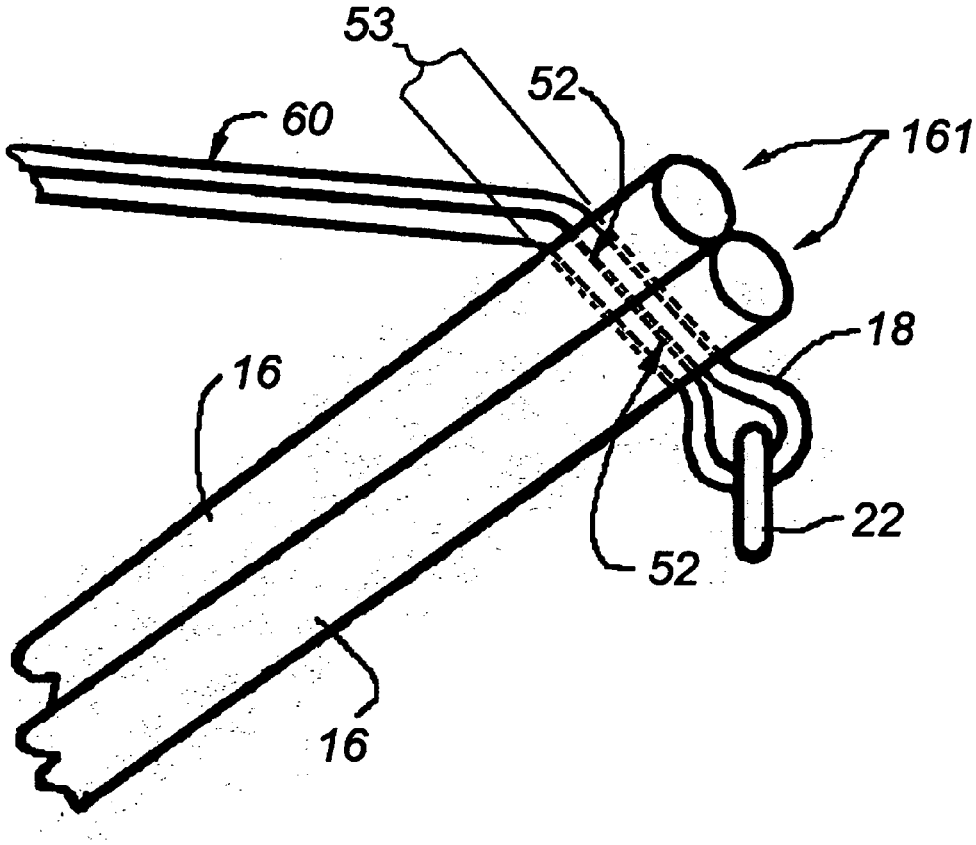
FIG. 9 is an enlarged fragmentary view of the upper portions of the artificial limb assembly according to the present invention as otherwise depicted in FIG. 3.

The support assembly 10 preferably comprises a pair of compression members as at 16; and a series of flexible cords or cording as at elements 14, 20, 21, and 40. Each compression member 16 has first compression member ends as at 161, second compression member ends as at 162, and a longitudinal compression member axis as at 164. The first compression member ends 161 respectively comprise a lone bore 52, which bores 52 are preferably formed orthogonally relative to the compression member axes 164. From a comparative inspection of FIGS. 7 and 9, it will be seen that the first compression member ends 161 are stackable upon one another such that the lone bores 52 are axially aligned and have a substantially uniform bore diameter as at 53.

The second compression member ends 162 each respectively comprise a distal bore as at 54 and a proximal bore as at 55. The second compression member ends 162 are spaceable from one another adjacent a vertical support structure (e.g. a tree as at 12) and as perhaps most clearly depicted in FIGS. 2 and 7. A first cord length (as at 21) of the series of cords extends through the proximal bores 55 thereby interconnecting the second compression member ends 162 for receiving the vertical support structure 12 and forming a first triangulate structure (i.e. the first triangulate structure comprises or is defined by compression members 16 and the first cord length 21).

A second cord length (as at 20) of the series of cords being folded for forming a double-cord length as referenced at 60 and a double-cord loop 18 at the end of the double-cord length 60. The uniform bore diameter 53 is preferably of sufficient size or dimension to receive the double-cord length 60 such that the double cord length 60 may extend through the stacked first compression member ends 161 via the axially aligned lone bores 52 thereby interconnecting the first compression member ends such that the double-cord loop 18 extends from the first compression member ends 161.

A third cord length and a fourth cord length (as at 40) of the series of cords respectively extend through the distal bores 54 and interconnect the distal bores 54 to the double-cord length 60 at a cord junction site 70 thereby forming second, third, and fourth triangulate structures. The second triangulate structure may be thought of as being defined by or comprising the double cord length 60, the third (or left) cord length 40, and a first of the compression members 16 (i.e. the left compression member 16).

Similarly, the third triangulate structure may the thought of as being defined by or comprising the double cord length 60, the fourth (or right) cord length 40, and a second of the compression members 16 (i.e. the right compression member16). The fourth triangulate structure may be thought of as being defined by or comprising the first cord length as at 21 and the third and fourth cord lengths as at 40. The first through fourth cord lengths thus form a support-accommodating, tetrahedral support assembly.

A fifth cord length (as at 14) of the series of cords extends from the cord junction site 70 for looping around and fastening the tetrahedral support assembly to the vertical support structure 12 such that the first compression member ends 161 are elevated relative to the second compression member ends 162 as perhaps as most clearly depicted in FIG. 3. The portable hammock assembly 100 may thus be said to further comprise certain means for fastening the tetrahedral support assembly to the vertical support structure as exemplified by peripheral-wrapping portion 14 as exemplified by chain, rope, strap, cable, etc. It is contemplated further that the portable hammock assembly 100 may preferably comprise certain vertical load connection means, which means may be exemplified by swivel ring 22.

The hammock or hammock assembly 110 preferably comprises a cross member as at 26; a sixth cord length (as at 24) of the series of cords, and a load-receiving support structure as exemplified by hammock chair or user-supportive net 28. The cross member 26 has first and second cross member ends as at 261. The sixth cord length 24 interconnects the first and second cross member ends 261 to the first compression member ends 161 via said vertical load connection means (e.g. swivel ring 22), which means are axially received by the cord loop 18 for preventing the cord loop 18 from retracting through the axially-aligned lone bores 52.

The load-receiving support structure (as at 28) is cooperatively associated with the cross member 26 for receiving and supporting a vertical load (e.g. a user as at 30). The tetrahedrally shaped support assembly 30 and hammock 110 thereby together interconnectedly comprise a series of substantially rigid members and a series of flexible members, which rigid and flexible members enable a user to knock down the otherwise fully assembled hammock assembly 100 such that the rigid members may be oriented into a substantially parallel configuration and the flexible members may be folded alongside the rigid members for ease of transport and portability.

Accordingly, although the invention has been described by reference to a preferred embodiment, it is not intended that the novel assembly be limited thereby, but that modifications thereof are intended to be included as falling within the broad scope and spirit of the foregoing disclosure, the following claims, and the appended drawings.

I claim:

1. A portable hammock assembly for supporting a vertical load adjacent a vertical support structure, the portable hammock assembly comprising:

a support assembly, the support assembly comprising a pair of compression members and a series of flexible cords, each compression member having first and second compression member ends and a longitudinal compression member axis, the first compression member ends respectively comprising a lone bore orthogonal to the compression member axis, the first compression member ends being stackable upon one another such that the lone bores are axially aligned, the lone bores having a uniform bore diameter, the second compression member ends each respectively comprising a distal bore and a proximal bore, the second compression member ends being spaceable from one another adjacent a vertical support structure, a first cord length of the series of cords extending through the proximal bores thereby interconnecting the second compression member ends for receiving the vertical support structure and forming a first triangulate structure, a second cord length of the series of cords being folded for forming a double-cord length and a double-cord loop at the end of the double-cord length, the uniform bore diameter being sized to receive the double-cord length, the double cord length extending through the stacked first compression member ends via the axially aligned lone bores thereby interconnecting the first compression member ends such that the double-cord loop extends from the first compression member ends, a third cord length and a fourth cord length of the series of cords respectively extending through the distal bores and interconnecting the distal bores to the double-cord length at a cord junction site thereby forming second, third, and fourth triangulate structures, the first through fourth triangulate structures thus forming a support-accommodating, tetrahedral support assembly, a fifth cord length of the series of cords extending from the cord junction site for looping around and fastening the tetrahedral support assembly to the vertical support structure such that the first compression member ends are elevated relative to the second compression member ends;

vertical load connection means, the cord loop for axially receiving the vertical load connection means; and a hammock, the hammock comprising a cross member, a sixth cord length of the series of cords, and a load-receiving support structure, the cross member having first and second cross member ends, the sixth cord length interconnecting the first and second cross member ends to the first compression member ends via said vertical load connection means, said means being axially received by the cord loop for preventing the cord loop from retracting through the axially-aligned lone bores, the load-receiving support structure being cooperatively associated with the cross member for receiving and supporting a vertical load, the tetrahedral support assembly and hammock thereby together interconnectedly comprising a series of substantially rigid members and a series of flexible members, said rigid and flexible members enabling a user to knock down the otherwise fully assembled hammock assembly such that the rigid members may be oriented into a substantially parallel configuration and the flexible members may be folded alongside the rigid members for ease of transport and portability.

2. The portable hammock assembly of claim 1 wherein the double cord length is adjustable for varying the effective distance intermediate the vertical load and the vertical support structure.

3. The portablc hammock assembly of claim 2 wherein the compression members each comprise a maximal compression member length, the maximal compression member length being about 100 centimeters.

4. The portable hammock assembly of claim 3 wherein the compression members and the series of flexible cords comprise non-abrasive structure, the non-abrasive structure for preventing damage to the vertical support structure.

5. The portable hammock assembly of claim 4 wherein the compression members each comprise at least two telescopic members, the telescopic members for enabling the user to vary the lengths of the compression members.

6. A portable hammock assembly for supporting a vertical load, the portable hammock assembly comprising:

a support assembly, the support assembly comprising a pair of compression members and a series of cords, each compression member having first and second compression member ends, and a compression member axis, the first compression member ends each comprising a lone bore, the first compression member ends being stackable upon one another such that the lone bores are axially aligned, the second compression member ends each comprising a distal bore and a proximal bore, the second compression member ends being spaceable from one another adjacent a vertical load support structure, a first cord length of the series of cords extending through the proximal bores thereby interconnecting the second compression member ends for receiving the vertical support structure and forming a first triangulate structure, a second cord length of the series of cords comprising a cord loop at the end of the second cord length, the second cord length extending through the stacked first compression member ends via the axially aligned lone bores thereby interconnecting the first compression member ends such that the cord loop extends from the first compression member ends, a third cord length and a fourth cord length of the series of cords respectively extending through the distal bores and interconnecting the distal bores to the second cord length at a cord junction site thereby forming second, third, and fourth triangulate structures, the first through fourth triangulate structures thus forming a support-accommodating, tetrahedral support assembly;

means for fastening the tetrahedral support assembly to the vertical support structure such that the first compression member ends are elevated relative to the second compression member ends;

vertical load connection means, the cord loop for receiving the vertical load connection means; and a hammock, the hammock comprising a cross member, a fifth cord leng of the series of cords and a load-receiving support structure, the cross member having first and second cross member ends, the fifth length of cord interconnecting the first and second cross member ends to the first compression member ends via said vertical load connection means, said means being received by the cord loop for preventing the cord loop from retracting through the axially-aligned lone bores, the load-receiving support structure being cooperatively associated with the cross member for receiving and supporting a load, the tetrahedral support assembly and hammock thereby together interconnectedly comprising a series of compression members and a series of cord members, said series of compression and cord members enabling a user to knock down the otherwise fully assembled hammock assembly such that the compression members may be oriented into a substantially parallel configuration and the cord members may be folded alongside the compression members for ease of transport and portability.

7. The portable hammock assembly of claim 6 wherein the means for fastening the tetrahedral support assembly to the vertical support structure comprise a sixth cord length of the series of cords, the sixth cord length extending from the cord junction site for looping around and fastening the tetrahedral support assembly to the vertical support structure.

8. The portable hammock assembly of claim 7 wherein the second cord length is adjustable for varying the effective distance intermediate the vertical load and the vertical support structure.

9. The portable hammock assembly of claim 8 wherein the compression members each comprise a maximal compression member length, the maximal compression member length being about 100 centimeters.

10. The portable hammock assembly of claim 9 wherein the compression and cord members comprise non-abrasive structure, the non-abrasive structure for preventing damage to the vertical support structure.

11. The portable hammock assembly of claim 10 wherein the compression members each comprise at least two telescopic members, the telescopic members for enabling the user to vary the effective lengths of the compression members.

12. A portable hammock assembly for supporting a vertical load, the portable hammock assembly comprising:

a tetrahedral support assembly and a hammock, the support assembly comprising two compression members, a series of tension members, and fastening means for fastening the tetrahedral support assembly to a vertical support structure, each compression member having first and second compression member ends, the first compression member ends each comprising a lone bore, the first compression member ends being stackable upon one another such that the lone bores are axially-aligned, the second compression member ends each comprising a distal bore and a proximal bore, the second compression member ends being spaceable from one another adjacent a vertical load support structure, a first of the tension members interconnecting the second compression member ends via the proximal bores thereby interconnecting the second compression member ends for receiving the vertical support structure and forming a first triangulate structure, a second of the tension members interconnecting the first compression member ends via the lone bores, a first end of the second tension member being outfitted with means for receiving a vertical load, a third and a fourth tension member respectively extending through the distal bores and interconnecting the distal bores to the second tension member at a tension member junction site thereby forming second, third, and fourth triangulate structures, the first through fourth triangulate structures thus forming the support-accommodating, tetrahedral support assembly, said fastening means being cooperable with the tension member junction site for fastening the tetrahedral support assembly to the vertical support structure such that the first compression member ends are elevated relative to the second compression member ends, the hammock comprising a cross member, a fifth tension member, and a load-receiving support structure, the cross member having opposed cross member ends, the fifth tension member interconnecting the cross member ends to the first compression member ends via said means for receiving a vertical load, the load-receiving support structure being cooperatively associated with the cross member for receiving and supporting a load, the tetrahedral support assembly and hammock thereby together interconnectedly comprising two compression members, a cross member, and a series of tension members for enabling a user to knock down the otherwise fully assembled hammock assembly for ease of transport and portability.

13. The portable hammock assembly of claim 12 wherein said means for fastening the tetrahedral support assembly to the vertical support structure comprise a sixth tension member the sixth tension member extending from the tension member junction site for looping around and fastening the tetrahedral support assemblyto the vertical support structure.

14. The portable hammock assembly of claim 12 wherein the second tension member has an adjustable tension member length interconnecting the first compression member ends with the tension member junction site for varying the effective distance intermediate the vertical load and the vertical support structure.

15. The portable hammock assembly of claim 12 wherein the compression members each comprise at least two telescopic members, the telescopic members for enabling the user to vary the compression member lengths.

* * * * *